United States Patent [19]

Buehler et al.

[11] Patent Number: 4,930,334

[45] Date of Patent: Jun. 5, 1990

[54] QUICK CHANGE STRUCTURE FOR TRIM DIE

[75] Inventors: Edgar J. Buehler, Pewaukee; James H. Draeger, Beaver Dam; Rayment G. Koopmans, Fox Lake, all of Wis.

[73] Assignee: Deere & Company, Moline, Ill.

[21] Appl. No.: 385,602

[22] Filed: Jul. 25, 1989

[51] Int. Cl.[5] ..... B21J 13/00

[52] U.S. Cl. ..... 72/448; 72/462; 72/481; 83/54; 83/188; 100/214; 100/918

[58] Field of Search ..... 83/54, 188, 929; 72/446, 448, 462, 481, 482; 100/214, 918

[56] References Cited

U.S. PATENT DOCUMENTS

| | | | |
|---|---|---|---|
| 4,424,742 | 1/1984 | Yamashita | 72/448 |
| 4,630,536 | 12/1986 | Shah | 72/448 |
| 4,785,695 | 11/1988 | Riley | 83/54 |
| 4,866,974 | 9/1989 | Shiraishi et al. | 72/448 |
| 4,866,975 | 9/1989 | Hopkins | 72/446 |

*Primary Examiner*—David Jones

[57] ABSTRACT

A quick change apparatus for a trim die assembly is provided to reduce die set-up and change-over time. The trim die assembly is provided with lift hooks for the forks of a forklift truck to carry it between storage and the press and to eliminate potentially damaging contact between the keyways in the bottom of the die and the forks. Locating pins and stops are provided between the press and die assembly to permit quick and positive positioning of the die assembly above the press bed. The connecting post between the part locator member of the trim die and the press has been modified to eliminate its projection beneath the die assembly and therefore eliminate damage to the post during set-up, movement and/or storage. The modified post is also adapted to assist in the positioning of the die assembly on the press bed.

16 Claims, 4 Drawing Sheets

Fig. 4
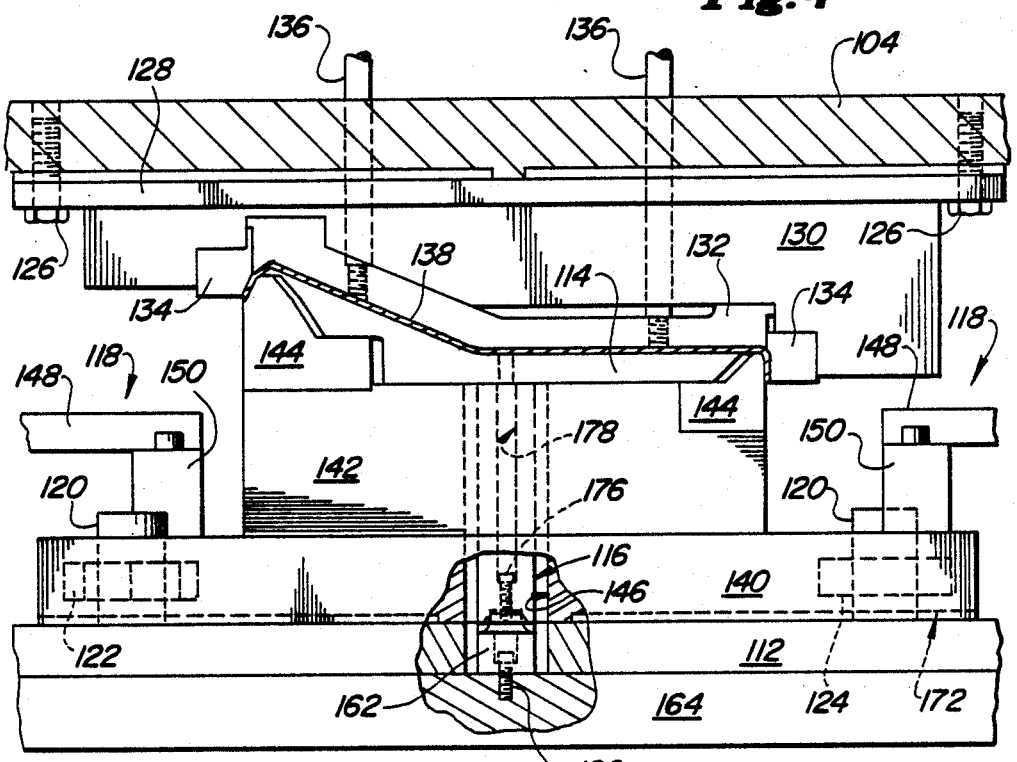
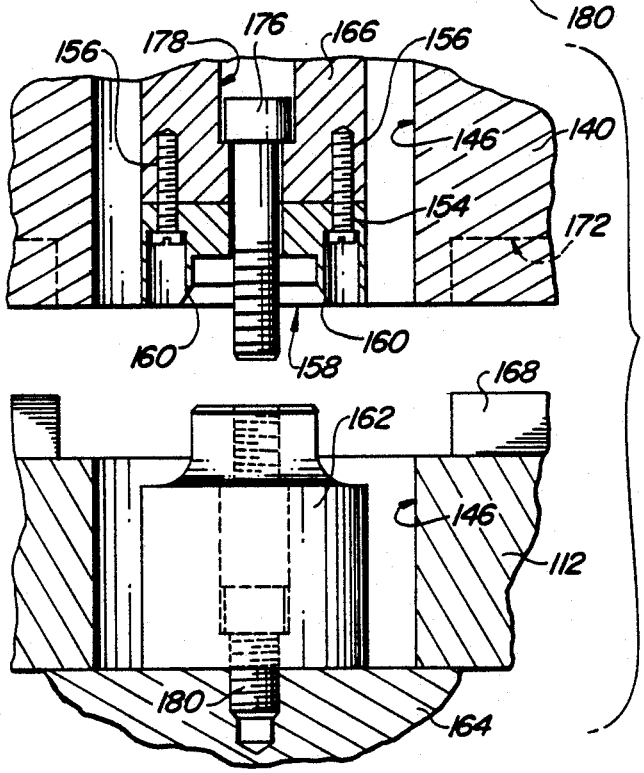
Fig. 5

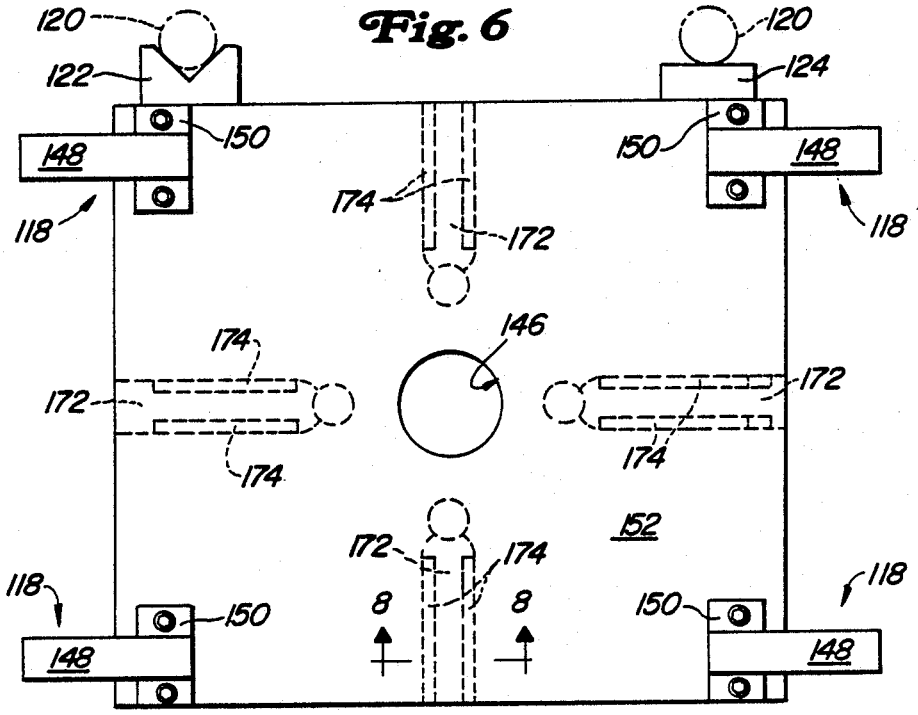
Fig. 6
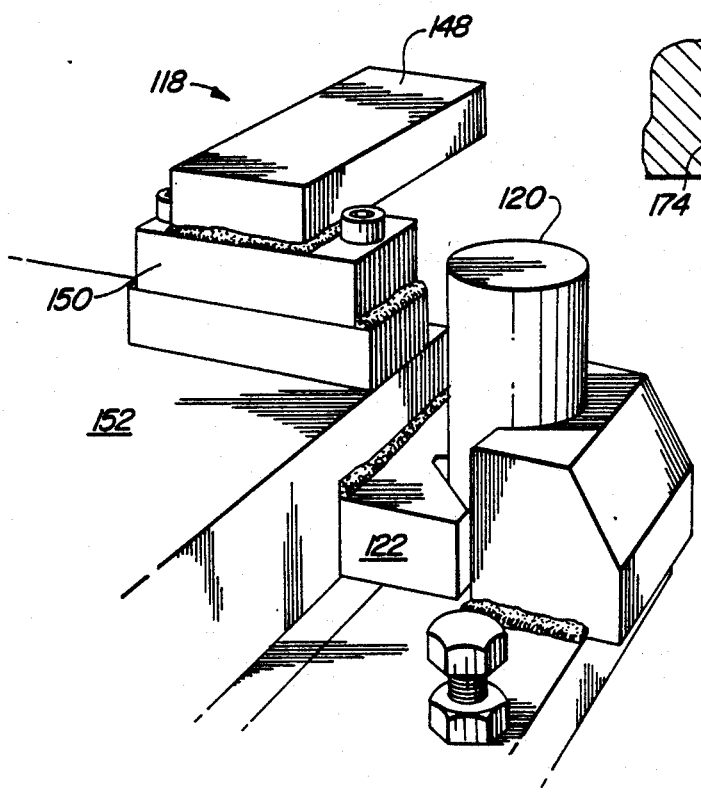
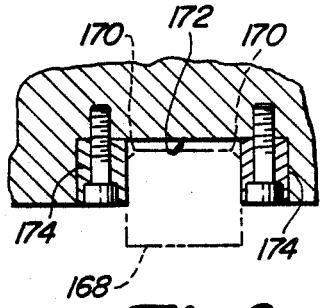
Fig. 8
Fig. 7

QUICK CHANGE STRUCTURE FOR TRIM DIE

FIELD OF THE INVENTION

The present invention relates to the changing of dies in presses, and more specifically relates to an improved apparatus for installing and removing trim dies.

BACKGROUND OF THE INVENTION

Trim dies are commonly used in manufacturing operations to produce lawn mower housings, engine covers and other types of drawn shell components which must be trimmed along the vertical walls of the shell.

A typical trim die used to accomplish the trimming of the peripheral edges of a drawn shell is illustrated in the prior art drawing of FIG. 2. The drawn shell, which is to be trimmed, is positioned on a part locator member 10 that is carried on the top portion of the die's lower section or shoe 12. A stripper plate 14, configured to mate with the part locator member 10 is carried on the upper shoe 16 of the die so that as the press ram 18 is lowered, the drawn shell will be secured between the stripper plate 14 and part locator member 10.

To shear the vertically extending walls of a drawn shell while it is secured between the stripper plate 14 and part locator member 10, the lower die shoe 12 is equipped with a punch 20 that interacts with a trim die ring 22 carried on the upper die section or shoe 16. For the punch 20 to cooperate with the die ring 22 and shear the shell walls, the lower shoe 12 must be shifted laterally and transversely. A trim die press is equipped with the capability to transversely and laterally shift bed or wobble plate 24, upon which is carried the lower die shoe 12.

To enable the part locator member 10 and drawn shell to remain stationary while the lower die shoe 12 is shifted transversely and laterally, the part locator 10 is attached to the press by one or more posts or pillars 26 which pass through openings or channels 28 in the lower die shoe 12 and wobble-plate or press bed 24.

Since the posts 26 of the part locator members 10 must pass through the lower die section 12 and wobble plate 24 to be connected to the press, they will project below the bottom plate 30 of the die when it is removed from the press.

While it is generally preferable to first position a die assembly on the bed of a press when installing it, it is necessary to install a trim die by attaching the upper shoe 16 of the die to the press ram 18 first so as to avoid damage to the posts 26 which project below the die.

Typically, installation of a trim die in a press is accomplished through the use of a fork truck. The forks are positioned beneath the die to lift it into place against the ram 18 of the die and then bolt the upper die section or shoe 16 to the press ram 18. Such maneuvering can be very time-consuming, expensive and potentially cause damage to the posts 26, keyways 32 carried on the lower shoe of the die and keys 34 on the press or wobble plate 24.

After attaching the trim die to the ram 18, it is lowered to carefully align the posts or pillars 26 with the openings 28 in the wobble plate 24 and align the keyways 32 carried within the bottom die shoe plate 30 with the keys 34 carried on the wobble plate 24. Since the posts or pillars 26 project from the bottom of the die a greater distance than the keys 34 extend above the wobble plate 24, the posts 26 will contact the wobble plate 24 before the keys 34 engage the keyways 32 in the lower shoe 12 and may incur damage.

Generally, trim die posts or pillars 26 are also equipped with keys 36 on their lower ends which mate with keyways carried in the press in order to lock the posts 26 in a specific orientation relative to the press (see FIG. 3). Damage to those keys 36 can also occur as the die is lowered should the posts 26 not be precisely aligned with the openings in the wobble plate 24 or should foreign material be lodged in the openings or stuck to the posts 26. If foreign material is lodged in the post openings, the post 26 may not seat properly and the part locator member 10 may not be properly seated on the die. Should the locator member 10 not be seated properly, the trim die punch 20 may either not shear the drawn shell wall at all or cut it in the wrong location.

Because trim dies are often moved and positioned by a lift truck, the forks may come into contact with the bottom of the posts 26, occasionally causing damage to the keys 36 carried thereon.

For these reasons, it is desirable to provide a die change structure which eliminates the need to position the forks of a forklift truck beneath the die where they can cause damage to the trim die posts, its keys and/or the keyways of the die, and to further provide a structure for quickly installing and/or changing trim dies which does not require that they be carefully and tediously maneuvered into a position of alignment with the ram of the press before being seated on and secured to the bed of the press.

SUMMARY OF THE INVENTION

The present invention provides an improved locating and die change structure for trim dies.

It includes forklift hooks which are installed on the top surface of the lower shoe's die plate. With the hooks above the lower surface of the lower shoe, the forks of the lift truck need not be positioned beneath the bottom of the die where they could contact the keys and/or posts which may project below the bottom of the lower die shoe. Additionally, it is easier for the operator to see the bottom of the die and its keyway openings as he positions it in the press.

The posts or pillars which connect the part locator member of the lower shoe with the press has been modified so that they do not project below the bottom of the lower die shoe. In this way the die can first be connected to the press bed rather than the press ram. Further, damage to the posts during movement or storage is avoided.

To eliminate the projection of the posts below the die, they have been shortened and adapters have been connected to the posts within the bottom die plate of the lower shoe. The adaptors are configured to mate with inserts which are positioned in openings in the wobble plate. The inserts are in turn connected to the press. While the inserts are designed to project above the wobble plate, they do not project as far as the wobble plate keys which serve to locate the bottom die plate of the lower shoe, both transversely and horizontally on the wobble plate.

The height of the keys has been increased so that they engage the keyways in the bottom die plate and locate the die relative to the wobble plate before the post adaptors are seated onto the inserts to couple the posts with the press. To minimize damage to the keys and keyways, the keys have been hardened as have the liners which have been installed in the sides of the keyways.

Further provided on the wobble plate are rough locator pins. One pin is located on each side of the back of the wobble plate to provide stops against which the die can easily and quickly be positioned. A pair of blocks are carried on the back side of the lower die shoe to engage the pins as the die is moved rearwardly in the press. One block takes the form of a V while the other block has a flat vertical surface, the V block being designed to locate the back of the die, both laterally and transversely, after which the flat block, when brought into alignment with the other locating pin, positions the other side of the die. With these locator pins and blocks, the operator can quickly position the die over the wobble plate for mounting to the bed of the press first. Then the die is lowered to seat the keys of the wobble plate into the keyways of the lower shoe die plate and seat the post adaptors with the post inserts. Once the die is seated onto the keys of the wobble plate, the locator pins would be slightly spaced from their blocks. In the preferred embodiment, this space is approximately 0.020 inch.

With forklift hooks, the modified posts and the locating pins, the trim die change time can be significantly reduced and damage incurred to trim die posts has been eliminated.

BRIEF DESCRIPTION OF THE DRAWINGS

FIG. 4 is an enlarged side view of the present invention incorporated into a trim die.

FIG. 5 is an enlarged view of the post insert and adaptor illustrated in FIG. 4.

FIG. 6 is a top view of the lower die plate, the hooks and locator blocks. Shown in phantom are the locator pins and keyways.

FIG. 7 is an enlarged side elevational view of one left hook, and the V-block locator and pin.

FIG. 8 is an enlarged view of the keyway in the lower die section taken along view 8—8 of FIG. 6 with a partial key from the wobble plate inserted in the keyway.

DETAILED DESCRIPTION OF THE PREFERRED EMBODIMENT

Figure 1:
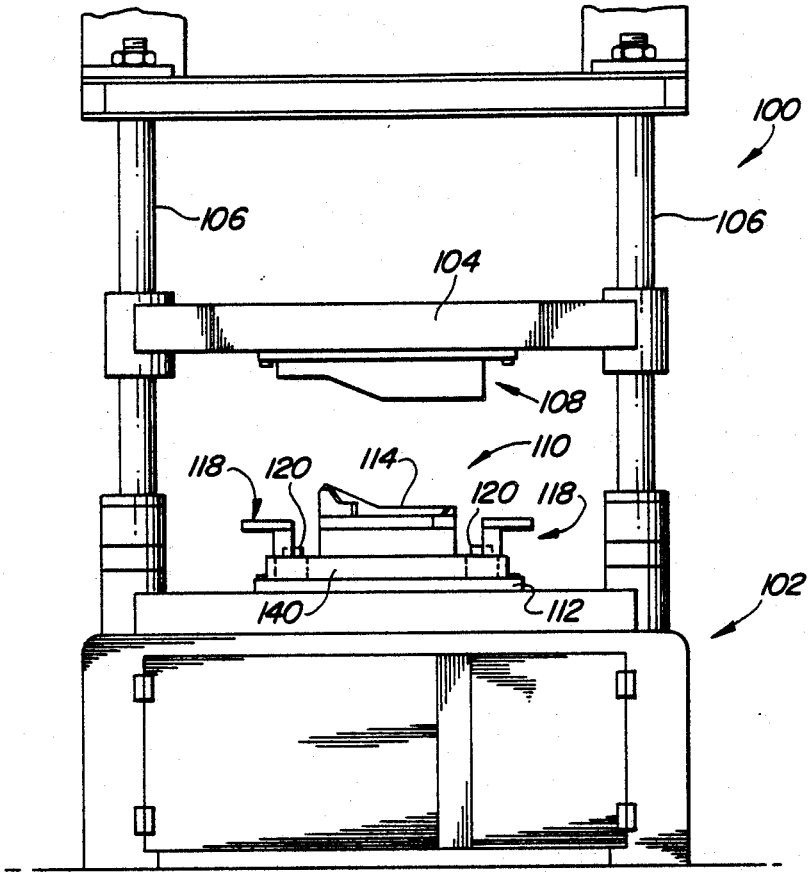
FIG. 1 is a side view of a die having the invention installed in a press.

Looking now to FIG. 1, there is illustrated a press 100 having a trim die assembly which uses the present invention. The press 100 includes a base 102 and a ram 104 carried on guides 106. The die assembly is comprised of an upper die section 108 carried by the ram 106 and a lower die section 110 mounted on a wobble plate 112 which is conventionally supported on the press 100. The typical press 100 upon which a trim die is mounted is equipped with a mechanism which shifts the bed or wobble plate 112 transversely and laterally to move the lower section 110 of the die transversely and laterally.

Figure 2:
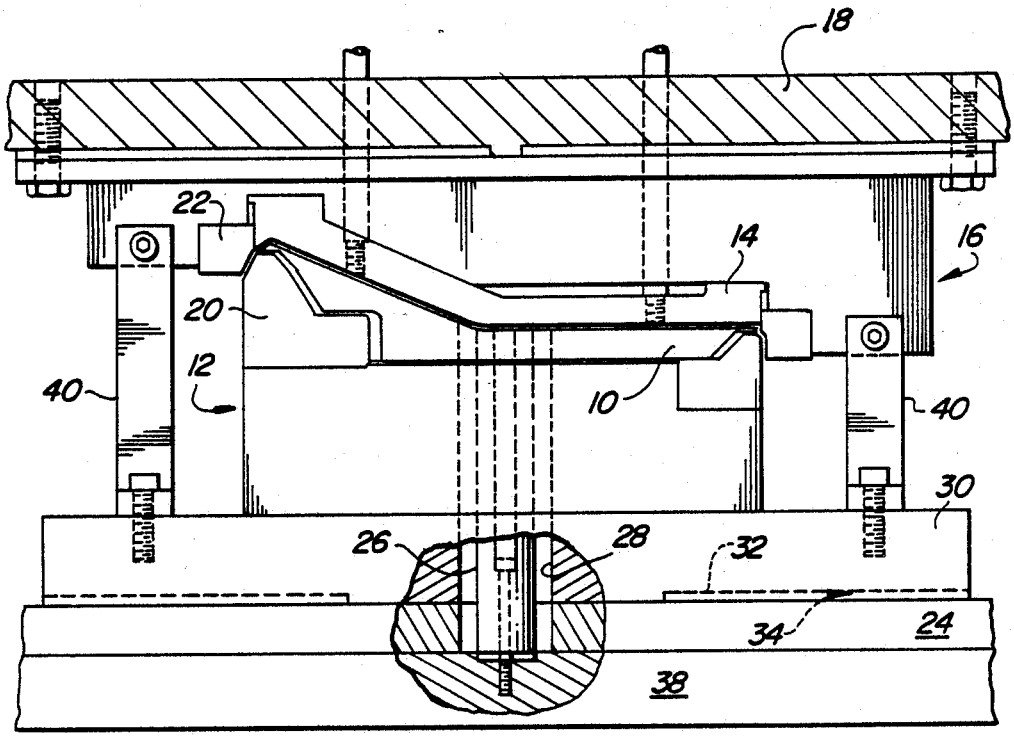
Fig. 2 (PRIOR ART)
FIG. 2 is a view of the prior art trim die.
Figure 3:
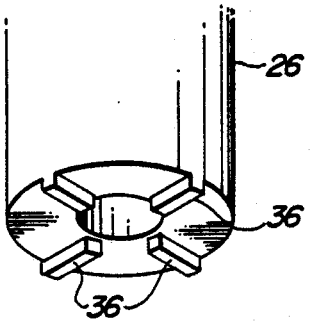
Fig. 3 (PRIOR ART)
FIG. 3 is an enlarged view of the prior art post and its keys.

The lower section 110 of the die includes a part locator member 114 carried on its top portion. As best illustrated in FIG. 2, the prior art part locator member 10 of the trim die included a post 26 which extended through the lower die shoe 12 and wobble plate 24 being connected to a retainer plate 38 in the base of the press. The post 26 secured the part locator member 10 to the press as the lower die section 12 was shifted transversely and laterally by the wobble plate 24. The improved trim die assembly illustrated in FIG. 4 includes the prior art die assembly of FIG. 2 with a modified post assembly 116 and the added lift hooks 118 and locator pins 120 and blocks 122 and 124. In FIG. 4 there is shown an upper shoe or section 108 and a lower shoe or section 110. The upper shoe 108 is attached to the ram 104 by bolts 126 and includes a top die plate 128, filler blocks 130, a stripper plate 132, and a trim die ring 134. Stripper bolts 136 pass through the filler blocks 130 in the top die plate 128 for shifting the stripper plate 132 to eject the trimmed part 138 as necessary.

A lower die section or shoe 110 is mounted on the wobble plate 112 of the press 102 and includes a bottom plate 140 upon which a filler block 142 is carried, a trim punch or cutting steels 144, and a part locator member 114 to which is attached a post 116 that extends through a channel or opening 146 in the filler block 142 and lower die plate 140.

The drawn shell or part 138 to be trimmed rests on the part locator member 114.

The improved die changing structure includes the lift means or hooks 118, the engageable locator means or locator pins 120, and blocks 122–124 and the coupling means or modified part locator post 116. Looking first to FIGS. 4, 6 and 7, there is illustrated the lift means or hooks 118 for receiving the forks of a lift truck. The lift hooks 118 are comprised of outwardly extending bars 148 welded to the blocks 150 which are in turn bolted to the upper surface 152 of the lower die section bottom plate 140. The spacing of the lift hooks 118 is such that the forks of the lift truck will quickly and easily slip beneath the hooks 118 to lift the die. A pair of lift hooks 118 are provided at the forward edge and as well as the rear edge of the bottom die plate 140 to provide secure and balanced support of the die assembly during its movement, storage and/or installation.

Again, looking at FIGS. 4, 6 and 7, there is illustrated the rough locator pins 120 and blocks 122, 124. The pins 120 are rigidly mounted on the wobble plate 112 and remain on the press as various trim dies are installed and/or removed. The locator blocks, one 122, taking the shape of a V and the other 124 having a flat vertical surface, are located on the rear edge of the bottom die plate 140. These blocks 122 and 124 are designed to enable the forklift operator to quickly move the die into the press 100 and accurately position it over the wobble plate 112 by first moving the die V block 122 into the pin 120 and then swinging the die assembly so that the flat block 124 contacts the other locator pin 120 to position the die in the fore-and-aft dimension relative to the press 100. The V block 122 also permits the operator to position the die assembly in the lateral dimension relative to the press 100.

Looking now to FIGS. 4 and 5, there is illustrated the modified post 116 which eliminates any projection of the post 116 beneath the bottom die plate 140. The modified post 116 includes first insert 154 which has been attached to the end of the prior art post which was shortened to accommodate the insert 154. The insert 154 is preferably flush with or slightly recessed in the bottom plate 140. It is connected by bolts 156 or other conventional means to the post. The insert 154 includes a recessed opening 158 having chamfered sides 160 for receiving the adaptor 162 which has been attached to a retainer plate 164 in the press 100. The adaptor 162 passes through the wobble plate 112 and extends slightly thereabove. The top of the adaptor 162 is compatibly shaped to be received within the recess 158 of the insert 154 for aligning the portion 166 of the post in the lower die section 110 with the remainder of the post formed by the adaptor or extension 162 carried in the wobble plate 112. As shown in FIGS. 4 and 5, the adaptor 162 projects above the wobble plate 112, but slightly less so than the adjacent key 168 carried on the wobble plate 112.

As illustrated in FIG. 8, the corners 170 of the keys 168 have been chamfered so that they will quickly and easily slip into the keyways 172 carried on the bottom die plate 140. Both the surface of the key 168 and the liners 174 carried in the keyways 172 have been hardened so as to minimize damage which could occur to the keys 168 and keyways 172 as the dies are installed in the press and later removed.

Looking back to FIGS. 4 and 5, there is shown the socket-head cap screw 176 which is inserted through the opening 178 in the modified post to pass through the insert 154 and be connected to the adaptor 162. The adaptor 162 is in turn secured to the retainer plate 164 by the bolt 180. The modified post, with its insert 154 and adaptor 162, is carried within channels 146 provided in the lower section 110 of the die and the wobble plate 112. The channels 146 are sized to enable the modified post to remain motionless while the wobble plate 112 and lower die section 140 are shifted transversely and laterally to effect the trimming operation on the drawn shell 138.

To install a die assembly equipped with the improved die change structure, an operator will move his forklift truck to the storage rack, inserting the forks under the lift hooks 118 provided on the bottom plate 140 of the lower die shoe 110. Each fork will pass under two hooks, one positioned at the front and one at the rear of the die bottom plate 140 for balanced lifting and transport of the die assembly. During this stage of die movement, the top and lower shoes 108 and 110 of the die assembly are secured together through conventional means, such as the straps 40 illustrated in the prior art drawing of FIG. 2.

Upon reaching the press 100, the operator will move the die assembly into the press bed area, passing it slightly above the wobble plate 140 to position the die locator blocks 122 and 124 against the locator pins 120 carried on the back of the wobble plate 112. The V block 122 is first positioned against its pin 120 and the die assembly then moved to cause the flat block 124 to abut the other locator pin 120 and position the die assembly laterally as well as transversely within the press bed area.

The operator may then gently lower the die assembly onto the wobble plate 112. Since the keys 168 carried on the wobble plate project higher than the post adaptor 162 carried within the wobble plate 112, they will first engage the keyways 172 of the bottom plate 140 of the die. As the keys 168 engage the keyways 172, the die assembly is positioned both laterally and transversely and the post adaptor 162 will slide into the opening 158 of the post insert 154. Upon engagement of the keys 168 with the keyways 172 and the post adaptor 162 with the insert 154, the operator will be able to bolt the lower die section 110 to the wobble plate 112 to secure it for operation. With the die bolted to the wobble plate 112, approximately 0.020 inch gap will exist between the locator pins 120 and blocks 122 and 124.

Because the lift forks of the lift truck were not positioned beneath the die for its transport and installation, no contact of the forks with the keyways in the lower die plate or inadvertent contact with the keys of the wobble plate could occur. Similarly, no contact between the forks and the post adaptor could occur.

Subsequent to securing the lower section 110 of the die to the wobble plate 112, the press ram 104 can be lowered to allow the operator to connect the upper section of the die to it. Once the upper section 108 of the die has been secured to the ram 104, straps connecting the two die sections would be removed and the ram 104 and upper die section 108 would be raised. The operator then inserts the socket head cap screw 176 through the part locator member 114 and into the opening 146 provided in the post 116 and insert 154 to secure the locator part 114 to the adaptor 162 and the retainer 164 carried in the press 100.

Removal of the die from the press for storage is similarly quick and simple. The operator first lifts the press ram 104 to enable him to loosen the socket cap screw 176 so that the locator part 114 is no longer attached to the press 100. The ram 104 is then lowered so that the upper die section 108 rests upon the lower die section 110. The straps for securing the top and bottom die sections 108 and 110 together can then be installed. The bolts 126, which attach the upper and lower sections 108 and 110 to the ram 104 and wobble plate 112, respectively, can similarly be removed. The ram 104 would then be lifted and the forklift operator could quickly and easily insert the lift truck forks under the lift hooks 118 to raise the die, remove it from the press and transport it back to the storage rack.

The lift hooks 118 permit quick and easy movement of the die assembly without exposing the keyways 172, keys 168 or posts 116 to potential damage from the forks. The quick locator pins 120 allow the operator to generally locate the die assembly within the press above the wobble plate 112 quickly and positively so that it can be positioned to align the adaptor 154 and insert 162. The modified post structure eliminates the projection of the post from the die assembly, thereby preventing damage to the post during its storage and/or installation and/or removal. Because the post adaptor 162 projects to a lower height than the keys 168, it is not easily damaged during the die installation procedures. The hardening of the key 168 and liners 174 for the keyways further minimizes the likelihood of damage to the keys 168 and keyways 172 during the installation and removal procedures.

With the present invention, much quicker die change procedure for trim dies is made possible and the likelihood of damage occurring to the keys, keyways and/or part locator post is significantly reduced.

We claim:

1. An improved die changing apparatus usable with a trim die having an upper die section and a lower die section, the lower die section including a part locator member having a post means extending through an opening in the lower die section; said die being usable on a press having a ram and a shiftable bed, the bed including an opening through which the post means can be placed, the improvement comprising:

at least two spaced apart lift means carried on an upper portion of the lower die section;

engageable locator means carried on the bed and lower die section for laterally and transversely positioning the trim die relative to the bed; and means for coupling the post means with the press including an adaptor being rigidly connected to the post means and being positioned substantially within the opening of the lower die section and an insert carried within the opening of the bed, said insert being secured to the press, and projecting above the bed and being engageable with the adaptor.

2. The invention defined in claim 1 wherein a connecting member can be inserted through the post means, and coupling means rigidly interconnect them.

3. The invention defined in claim 2 wherein the connecting member interconnects the part locator member with the adaptor and insert.

4. The invention defined in claim 1 wherein keyway means is further provided between the bed and lower die section to precisely locate them relative to one another.

5. The invention defined in claim 4 wherein the keyway means includes a key carried by the bed for engagement with a keyway in the lower die section and the key projects from the bed a distance above the insert.

6. The invention defined in claim 5 wherein the surfaces of the key and keyway include case hardened material.

7. The invention defined in claim 1 wherein the lift means includes four L-shaped lift hooks carried on outer portions of the lower die section.

8. The invention defined in claim 1 wherein the locator means includes two locator pins carried by the bed, said pins being engageable respectively with flat and V-shaped receiving blocks, carried by the lower die section.

9. An improved trim die usable with a press having a shiftable bed adapted for generally horizontal movement relative to the press ram, the die including an upper die section mountable to the ram of the press and a lower die section mountable to the bed for movement therewith, and a part locator member carried by the lower die section, said member having post means extending through the lower die section and the bed to rigidly secure the member to the press as said bed shifts; the improvement comprising:

at least two lift means carried on the lower die section above its lower surface and at spaced apart positions;

locator means between the shiftable bed and lower die section for positioning the lower die section relative to the bed;

coupling means between the post means and press including a first member carried by the post means, said member being generally flush with the lower surface of the plate means, and a second member extending through the top and bottom of the bed for being rigidly connected with the press and engageable with the first member.

10. The invention defined in claim 9 wherein the coupling means includes an adaptor rigidly mounted to the post means with substantially all of said adaptor being housed within the lower die section.

11. The invention defined in claim 10 wherein the coupling means further includes an insert projecting through the bed, one end of said insert being rigidly connected to the press with the other end of said insert projecting above the bed and being adapted to engage the adaptor as said lower die section is seated on the bed.

12. The invention defined in claim 11 wherein the lower die section and wobble plate carry engageable keyway means.

13. The invention defined in claim 12 wherein the keyway means includes a key carried by the bed which projects above the bed and the adaptor.

14. The invention defined in claim 13 wherein there is further provided a connecting means insertable through the adaptor and the insert to rigidly couple the adaptor and insert together as the connecting means is secured to the press.

15. The invention defined in claim 9 wherein the locator means includes at least two pins rigidly connected to the bed with blocks carried by the lower die section for engagement with the pins, at least one block having a V-shaped surface engageable with one pin.

16. The invention defined in claim 9 wherein the lift means includes four L-shaped lift hooks carried at spaced apart locations on the upper surface of the lower die section and adapted to receive the forks of a lift truck.

* * * * *